US007909659B2

(12) United States Patent
Cheng

(10) Patent No.: US 7,909,659 B2
(45) Date of Patent: Mar. 22, 2011

(54) ANTI-MISMATING ELECTRICAL CONNECTOR AND METHOD FOR MANUFACTING SAME

(75) Inventor: Yung-Chang Cheng, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/822,191

(22) Filed: Jun. 24, 2010

(65) Prior Publication Data

US 2010/0330842 A1 Dec. 30, 2010

(30) Foreign Application Priority Data

Jun. 24, 2009 (CH) ..... 2009 2 0304922

(51) Int. Cl.
*H01R 13/64* (2006.01)

(52) U.S. Cl. ..... 439/680

(58) Field of Classification Search ..... 439/674, 439/677, 680, 681
See application file for complete search history.

(56) References Cited

U.S. PATENT DOCUMENTS

| | | | | |
|---|---|---|---|---|
| 6,695,650 | B2 * | 2/2004 | Mueller | 439/680 |
| 7,037,120 | B1 | 5/2006 | Yeh | |
| 2008/0026640 | A1 * | 1/2008 | Zheng et al. | 439/626 |

* cited by examiner

*Primary Examiner* — Tho D Ta
(74) *Attorney, Agent, or Firm* — Ming Chieh Chang; Wei Te Chung; Andrew C. Cheng

(57) ABSTRACT

An electrical connector (100) includes an insulative housing (20), a plurality of conductive contacts retained in the insulative housing, a shielding member (3) covering the insulative housing and an insulative cover (50) molded outside of the shielding member. The insulative cover has a lever portion (53) extending inside the shielding member and being sandwiched between a portion of the shielding member and the insulative housing. The insulative cover defines a slit (510) on an outer surface (51) thereof for anti-mismating. The insulative cover has a floor piece (511) located below the slit. The lever portion is connected to the floor piece for preventing the floor piece from being cracked.

19 Claims, 6 Drawing Sheets

ANTI-MISMATING ELECTRICAL CONNECTOR AND METHOD FOR MANUFACTING SAME

BACKGROUND OF THE INVENTION

1. Field of the Invention

The present invention relates generally to an electrical connector, and more particularly to an electrical connector that is prevented from mis-mating with a mating connector.

2. Description of Related Arts

Electrical connectors, such as a USB (Universal Serial Bus) plug and a mating USB receptacle, are widely used in a portable electronic appliance. The USB plug usually comprises an insulative housing, a plurality of terminals retained in the insulative housing, a metal cover shielding over the insulative housing, and an insulative cover molded outside of the metal cover for protection. The insulative housing forms a tongue portion. The terminals partly extend beyond the tongue portion for engaging with the USB receptacle. The USB receptacle is fixed to the electronic appliance. The USB plug in use does not clearly indicate to a user which is an upper side or a lower side thereof, although a logo is labeled on the upper side or the lower side. A user sometimes needs more than one trial to finally, correctly engage the USB plug with the USB receptacle. Therefore, the USB plug is very easily destroyed during the tries to engage the two, especially under a large inserting force from the user. Accompanying with a miniaturization of the electronic appliance, the USB receptacle is minimized in size and accordingly, the USB plug is also required to be of a minimized size. With the minimized size of the USB plug, the terminals and the tongue portion are thinner, have decreased strength and are easily damaged.

Hence, an electrical connector with anti-mismating mechanism for preventing its damage and also for preventing damage to the mating connector is desired.

SUMMARY OF THE INVENTION

Accordingly, an object of the present invention is to provide an electrical connector with anti-mismating mechanism for preventing its damage and also for preventing damage to the mating connector.

To achieve the above object, an electrical connector includes an insulative housing, a plurality of conductive contacts retained in the insulative housing, a shielding member covering the insulative housing and an insulative cover molded outside of the shielding member. The insulative cover has a lever portion extending inside the shielding member and being sandwiched between a portion of the shielding member and the insulative housing. The insulative cover defines a slit on an outer surface thereof for anti-mismating. The insulative cover has a floor piece located below the slit. The lever portion is connected to the floor piece for preventing the floor piece from being cracked.

Other objects, advantages and novel features of the invention will become more apparent from the following detailed description when taken in conjunction with the accompanying drawings.

DETAILED DESCRIPTION OF THE PREFERRED EMBODIMENT

Referring to FIGS. 1-6, an electrical connector 100 of the present invention, preferably embodied in a USB (Universal Serial Bus) plug used for engaging with a mating connector (not shown) preferably embodied in USB receptacle, comprises an insulative housing 20, a plurality of conductive contacts (not shown) of conventional construction retained in the insulative housing 20, a shielding member 3 covering the insulative housing 20 and an insulative cover 50 molded outside of the shielding member 3 for protection.

Figure 1:
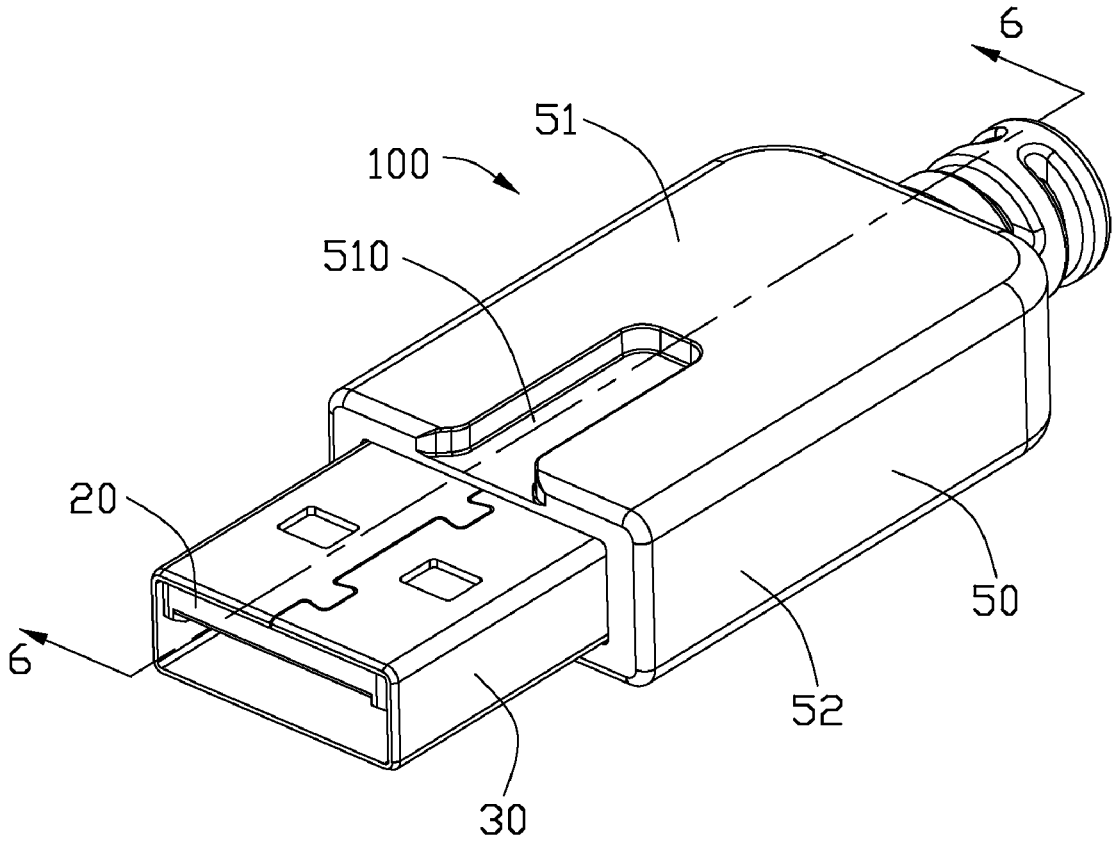
FIG. 1 is a perspective, assembled view of an electrical connector constructed in accordance with the present invention.
Figure 2:
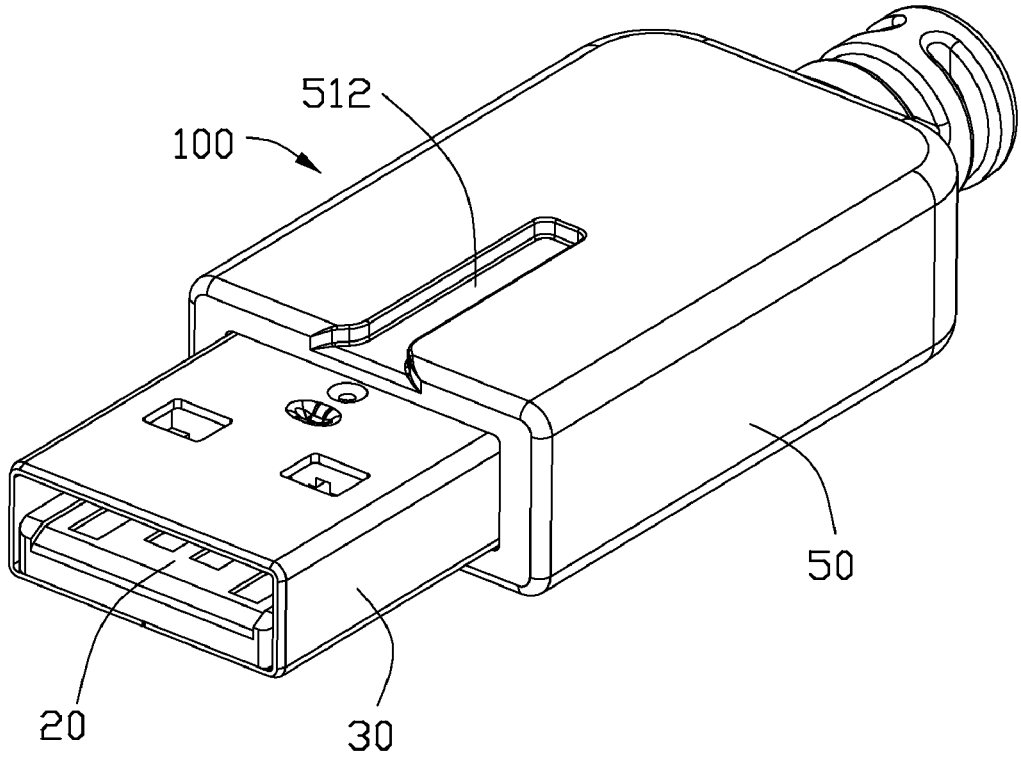
FIG. 2 is another perspective, assembled view of the electrical connector.
Figure 3:
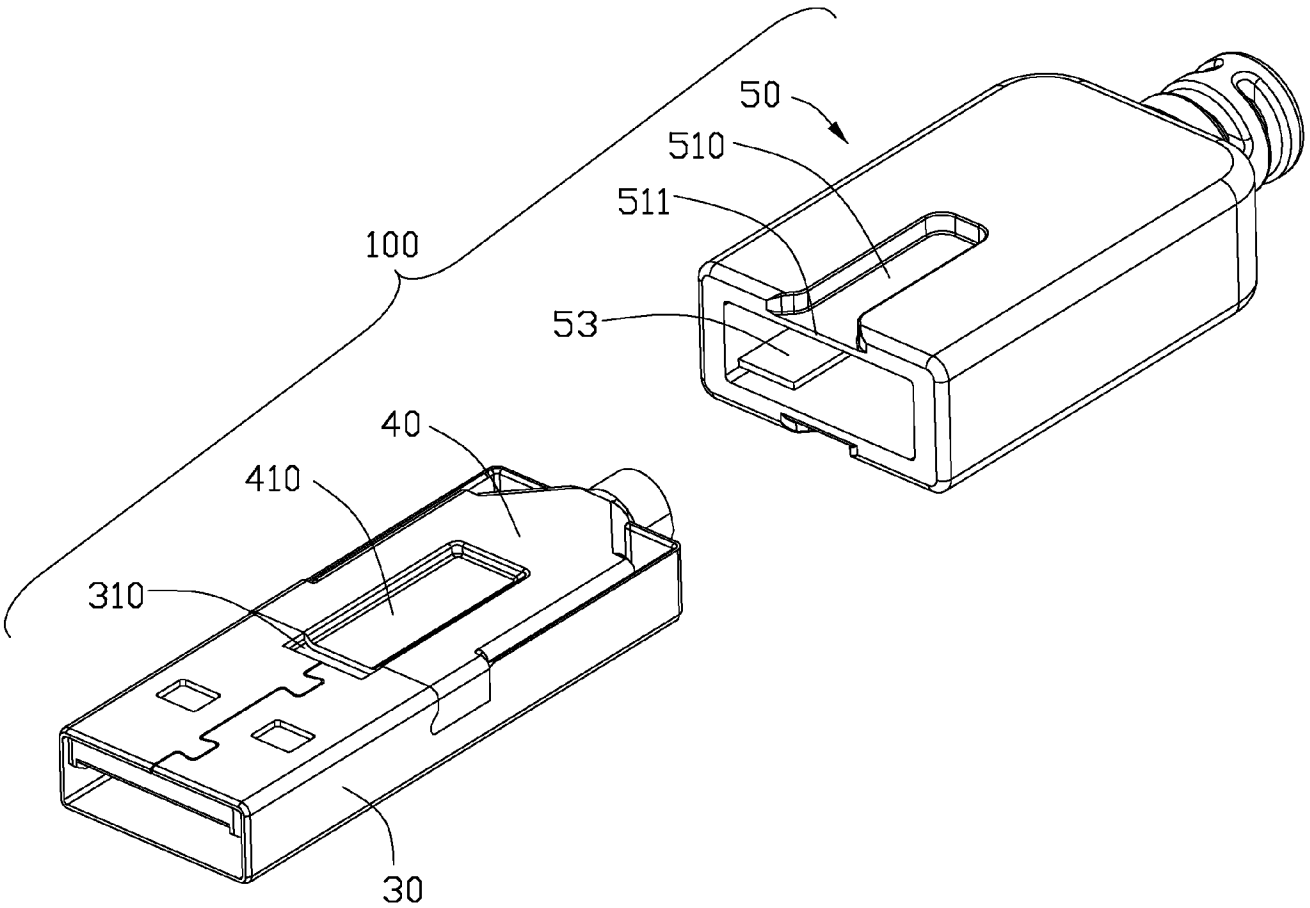
FIG. 3 is a perspective, partly exploded view of the electrical connector.
Figure 4:
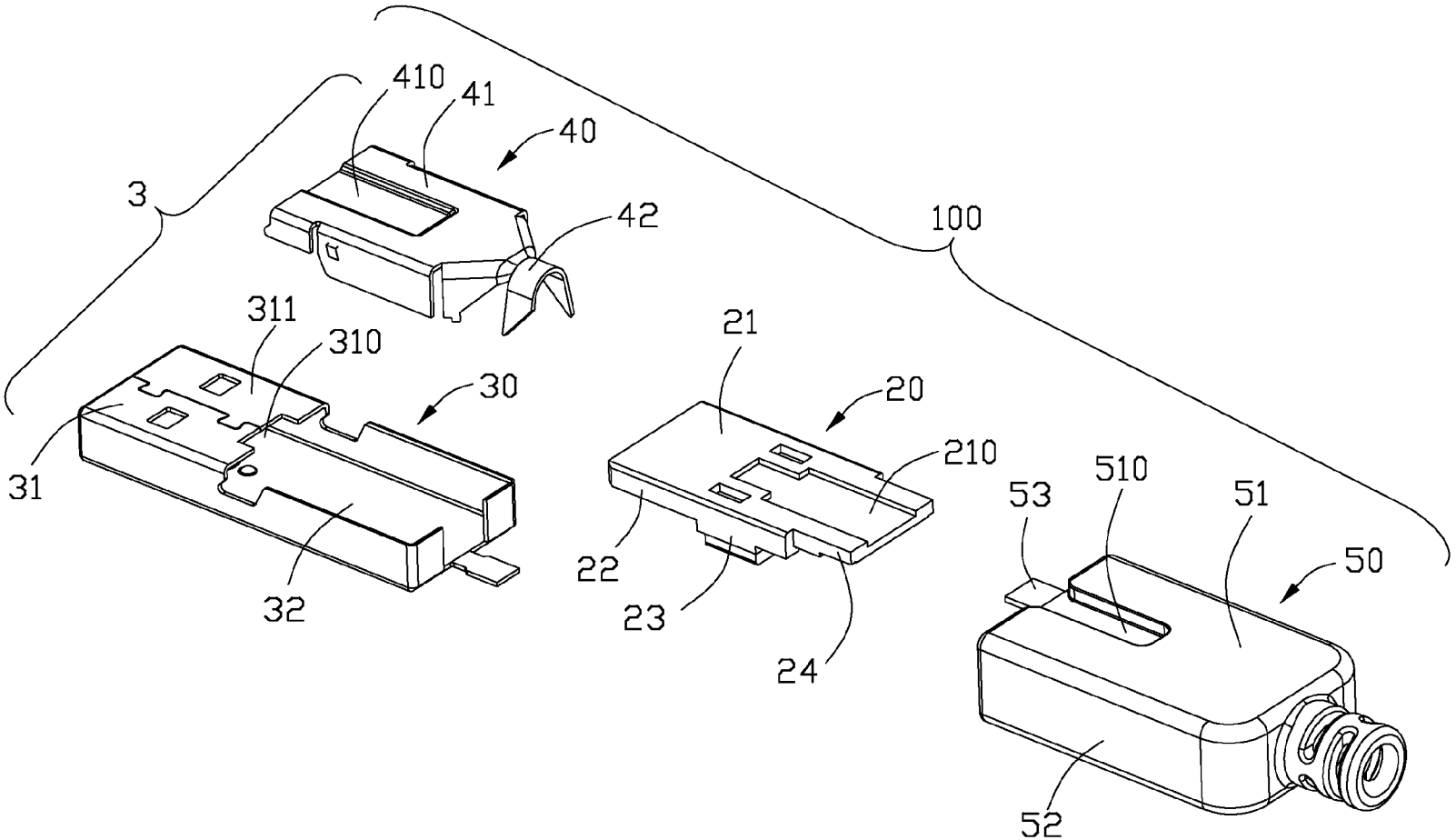
FIG. 4 is a perspective, exploded view of the electrical connector.
Figure 5:
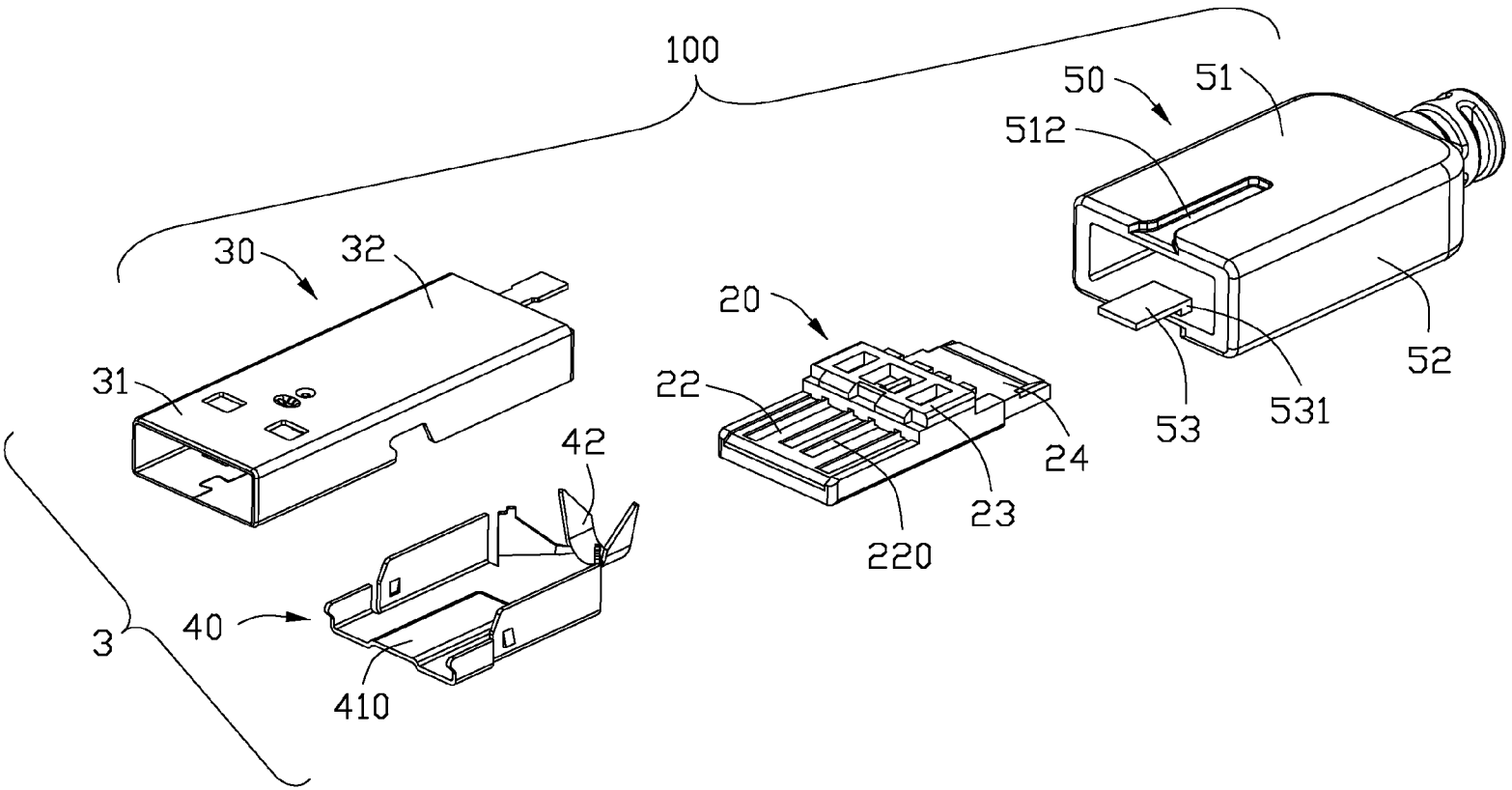
FIG. 5 is another perspective, exploded view of the electrical connector.
Figure 6:
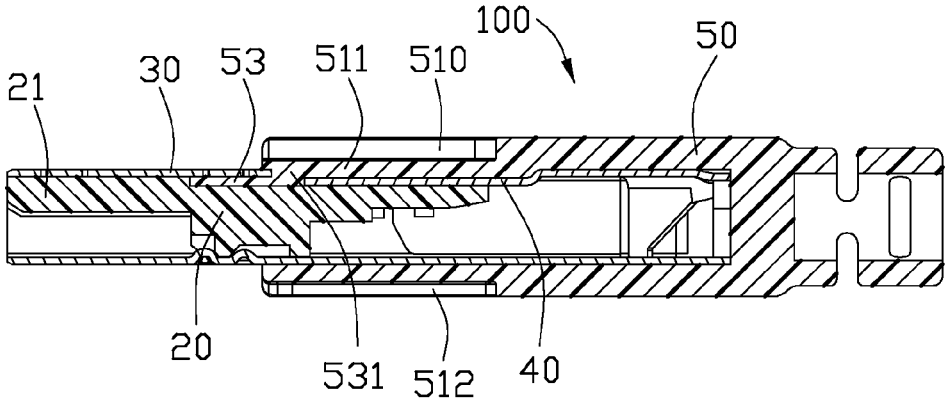
FIG. 6 is a cross-sectional view of the electrical connector taken along line 6-6 of FIG. 1.

Referring to FIGS. 3-5, the insulative housing 20 comprises a tongue portion 22 extending forward for engaging with the mating connector, a rear portion 24 extending rearward for coupling to a cable (not shown), and a connecting portion 23 between the tongue portion 22 and the rear portion 24. The connecting portion 23 protrudes higher than the tongue portion 22 and the rear portion 24 such that the tongue portion 22 and the rear portion 24 are separated from each other as two separated portions. The tongue portion 22 defines a plurality of passageways 220 extending from the front to the rear, passing through the connecting portion 23 to the rear portion 24. The conductive contacts are received in the passageways 220 and connect with the cable at the rear portion 24 for signal transmission. In a preferred embodiment, the cable comprises a plurality of wires soldering with the conductive contacts. The insulative housing 20 defines a cutout 210 at a lower side 21 of the insulative housing 20 which is opposite to the side defining the passageways 220. The cutout 210 has a first width and is mostly located at the rear portion 24 of the insulative housing 20. The cutout 210 further extends to the connecting portion 23 with a second width smaller than the first width.

Referring to FIGS. 4 and 5, the shielding member 3 comprises a first metal cover 30 and a second metal cover 40 securing to the first metal cover 30 for defining a receiving room for the insulative housing 20. The first metal cover 30 comprises a shroud portion 31 at a front part thereof and a sleeve portion 32 extending rearward from the shroud portion 31. The shroud portion 31 is wholly closed and receives the tongue portion 22 therein. The sleeve portion 32 is partly framed with an opening. The second metal cover 40 is mounted to fill up the opening and fasten with the sleeve portion 32 for cooperatively receiving the rear portion 24 of the insulative housing 20. The second metal cover 40 comprises a main portion 41 and a bundle portion 42 extending from the main portion 41 for retaining the cable. The main portion 41 defines a recess portion 410, at a front part thereof, which is appropriately immersed in the cutout 210 of the insulative housing 20. The shroud portion 31 of the first metal cover 30 comprises a bottom surface 311 leveling with the main portion 41 of the second metal cover 40. The bottom surface 311 defines a notch 310 facing to the recess portion 410. The notch 310 is arranged above and communicates the cutout 210 of the insulative housing 20 when assembled.

Referring to FIGS. 3-6, the insulative cover 50 is molded outside of the shielding member 3 and comprises a pair of outer surfaces 51 and a pair of lateral walls 52 connecting with the outer surfaces 51. The outer surfaces 51 and the lateral walls 52 cooperatively define a receiving space for partly receiving the shielding member 3. An upper outer surface 51 defines a first slit 510 and forms a floor piece 511 located below the first slit 510. The floor piece 511 is thinner than other parts of the upper outer surface 51 and is received in the recess portion 410 of the second metal cover 40 and supported by the second metal cover 40, such that the floor piece 511 has an increased strength. The floor piece 511 extends far enough to engage the bottom surface 311 of the first metal cover 30, i.e., the rear edge of the bottom surface 311 is embedded into the insulative cover 50. The insulative cover 50 further forms a lever portion 53 connecting with the floor piece 511 and extending beyond a front edge of the floor piece 511. The lever portion 53 extends parallel with the outer surface 51 and forms a linking portion 531 integrally connecting with the floor piece 511. The lever portion 53 protrudes into the cutout 210. The lever portion 53 is sandwiched between the insulative housing 20 and the bottom surface 311 of the first metal cover 30 to assist retention of the floor piece 511 in place. A lower outer surface 51 defines a second slit 512 having a size different from the first slit 510 of the upper outer surface 51 in this embodiment. The size herein refers to may be either width or depth, or length.

Referring to FIGS. 1-6, a manufacturing method of the electrical connector 100 is provided as following: providing an insulative housing 20 with a cutout 210 and retaining a plurality of conductive contacts; providing a first metal cover 30 comprising a shroud portion 31 at a front part thereof and a sleeve portion 32 extending rearward from the shroud portion 31, the shroud portion 31 defining a notch 310 at a bottom surface 311 thereof; assembling the insulative housing 20 into the first metal cover 30; securing a second metal cover 40 to the sleeve portion 32 of the first metal cover 30, cooperatively covering over the insulative housing 20 with the first metal cover 30; molding the insulative cover 50 outside of the first metal cover 30 and the second metal cover 40 with at least one outer slit 510 (or 512) for anti-mismating and partially filling the cutout 210 of the insulative housing 20 through the notch 310 to form a lever portion 53 between the insulative housing 20 and the bottom surface 311 of the first metal cover 30 which is finally integral with the insulative cover 50.

Referring to FIGS. 1-6, because the insulative cover 50 of the present invention defines a first slit 510 and a second slit 512 on opposite outer surfaces 51, and the first slit 510 and the second slit 512 have different sizes for meeting with different ribs of the mating connector, the electrical connector 100 is prevented from mis-mating with the mating connector. In other embodiment, the electrical connector 100 has only one of the outer surfaces 51 defining a slit 510 (or 512) while the other one does not have a slit. Such kind of the electrical connector 100 can also anti-mismate with the mating connector. Because the insulative cover 50 forms a lever portion 53 sandwiched between the insulative housing 20 and the bottom surface 311 of the first metal cover 30 for assisting retention of the floor piece 511, as well as the floor piece 511 is received in the recess portion 410 of the second metal cover 40 and supported by the second metal cover 40, the floor piece 511 is prevented from being cracked even if the floor piece 511 becomes thinner because of the slit 510 that is defined on the insulative cover 50.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative housing;

a plurality of conductive contacts retained in the insulative housing;

a shielding member covering the insulative housing; and an insulative cover molded outside of the shielding member, the cover having a lever portion extending inside the shielding member and being sandwiched between a portion of the shielding member and the insulative housing, the cover defining a slit on an outer surface thereof for anti-mismating, the insulative cover having a floor piece located below the slit; wherein the lever portion is connected to the floor piece.

2. The electrical connector as described in claim 1, wherein the insulative housing defines a cutout and the shielding member defines a notch communicating with the cutout with the lever portion being formed between the cutout and the notch.

3. The electrical connector as described in claim 2, wherein the lever portion has a linking portion integral with the floor piece.

4. The electrical connector as described in claim 2, wherein the shielding member comprises a first metal cover and a second metal cover secured to the first metal cover for cooperatively defining a receiving room for the insulative housing.

5. The electrical connector as described in claim 4, wherein the first metal cover has a shroud portion and a sleeve portion extending from the shroud portion and the shroud portion has a bottom surface leveling with the second metal cover.

6. The electrical connector as described in claim 5, wherein the second metal cover defines a recess portion facing the notch.

7. The electrical connector as described in claim 6, wherein the floor piece is received in the recess portion and supported by the second metal cover.

8. The electrical connector as described in claim 7, wherein the recess portion is received in the cutout of the insulative housing.

9. The electrical connector as described in claim 5, wherein the lever portion extends beyond a front edge of the floor portion.

10. The electrical connector as described in claim 9, wherein the floor piece extends to engage the bottom surface of the first metal cover.

11. The electrical connector as described in claim 1, further comprising a second slit on an opposite outer surface of the insulative cover, the second slit having a different from that of the slit.

12. The electrical connector as described in claim 11, wherein the slits have different widths and depths.

13. An electrical cable connector assembly comprising:

an insulative housing defining a forwardly extending tongue portion in a front-to-back direction, and a cutout formed in an exterior face thereof and essentially behind the tongue portion;

a plurality of contacts disposed in the housing with contacting sections exposed upon the tongue portion;

a metallic shell sub-assembly essentially circumferentially enclosing the housing; and an insulative cover, via an overmold procedure, enclosing a rear portion of the assembled insulative housing and metallic shell; wherein a portion of the insulative cover occupies a portion of the cutout and reaches a position to form a lever portion sandwiched between the insulative housing and the metallic shell in a vertical direction perpendicular to the front-to-back direction.

14. The electrical cable connector assembly as claimed in claim 13, wherein said insulative cover defines a slit in an outer surface proximate the exterior face of the housing for anti-mismating, and said slit is essentially aligned with the cutout in said vertical direction.

15. The electrical cable connector assembly as claimed in claim 13, wherein said metallic shell defines, around the exterior face of the housing, a notch through which the insulative cover invades the cutout to form the lever.

16. The electrical cable connector assembly as claimed in 13, wherein the metallic shell defines a recess portion to be received within the cutout of the housing.

17. The electrical cable connector assembly as claimed in claim 16, wherein said insulative cover defines a slit in an outer surface proximate the exterior face of the housing for anti-mismating, and said slit is essentially aligned with the recess portion of the metallic shell and the cutout of the insulative housing.

18. The electrical cable connector assembly as claimed in claim 16, wherein another portion of the insulative cover invades the recess portion.

19. The electrical cable connector assembly as claimed in claim 18, wherein said portion of the insulative cover and said another portion of the insulative cover are joined together along the front-to-back direction.

* * * * *